US009746177B2

(12) United States Patent
Broderick et al.

(10) Patent No.: US 9,746,177 B2
(45) Date of Patent: Aug. 29, 2017

(54) UREA DECOMPOSITION AND IMPROVED SCR NOX REDUCTION ON INDUSTRIAL AND SMALL UTILITY BOILERS

(71) Applicant: PEERLESS MFG. CO., Dallas, TX (US)

(72) Inventors: R. Gifford Broderick, Wilton, CT (US); Jeffrey Michael Broderick, Ridgefield, CT (US); Kathryn V. O'Leary, Southbury, CT (US); Scott H. Lindemann, Oxford, CT (US); James M. Valentine, Fairfield, CT (US)

(73) Assignee: PEERLESS MFG. CO., Dallas, TX (US)

( * ) Notice: Subject to any disclaimer, the term of this patent is extended or adjusted under 35 U.S.C. 154(b) by 706 days.

(21) Appl. No.: 14/077,978

(22) Filed: Nov. 12, 2013

(65) Prior Publication Data

US 2014/0134061 A1 May 15, 2014

Related U.S. Application Data

(60) Provisional application No. 61/725,371, filed on Nov. 12, 2012.

(51) Int. Cl.

| | |
|---|---|
| ***B01D 50/00*** | (2006.01) |
| ***F23J 15/00*** | (2006.01) |
| ***F23J 15/02*** | (2006.01) |

(52) U.S. Cl.

CPC ..... *F23J 15/006* (2013.01); *F23J 15/003* (2013.01); *F23J 15/022* (2013.01); *F23J 2215/10* (2013.01); *F23J 2217/101* (2013.01); *F23J 2217/20* (2013.01); *F23J 2217/30* (2013.01); *F23J 2219/10* (2013.01)

(58) Field of Classification Search

None

See application file for complete search history.

(56) References Cited

U.S. PATENT DOCUMENTS

| | | | |
|---|---|---|---|
| 5,282,355 | A | 2/1994 | Yamaguchi |
| 5,296,206 | A | 3/1994 | Cho et al. |
| 5,555,718 | A | 9/1996 | Anderson et al. |
| 5,809,774 | A | 9/1998 | Peter-Hoblyn et al. |

(Continued)

*Primary Examiner* — Jill Warden

*Assistant Examiner* — Dwayne K Handy

(74) *Attorney, Agent, or Firm* — Sean S. Wooden; Andrews Kurth Kenyon LLP

(57) ABSTRACT

A lean burn combustion source includes a first side stream comprising an inlet and an outlet, both positioned downstream of a furnace and upstream of a particulate control device, and a second side stream comprising: an inlet positioned downstream of the particulate control device and upstream of the catalyst, a heat exchanger section passing through the first side stream, whereby heat from hot exhaust gas flowing through the first side stream is transferred to hot exhaust gas flowing through the second side stream, an injector positioned in the second side stream injecting aqueous based reagent into the hot exhaust gas flowing through the second side stream such that the aqueous based reagent decomposes to ammonia gas, and an outlet in fluid communication with a reagent distribution device positioned in the primary exhaust gas stream downstream of the particulate control device and upstream of the catalyst.

31 Claims, 1 Drawing Sheet

(56) References Cited

U.S. PATENT DOCUMENTS

| | | | | |
|---|---|---|---|---|
| 5,968,464 | A | 10/1999 | Peter-Hoblyn et al. | |
| 6,203,770 | B1 | 3/2001 | Peter-Hoblyn et al. | |
| 6,322,762 | B1 | 11/2001 | Cooper et al. | |
| 6,361,754 | B1 | 3/2002 | Peter-Hoblyn et al. | |
| 6,436,359 | B1 | 8/2002 | Spencer, III et al. | |
| 7,090,810 | B2 | 8/2006 | Sun et al. | |
| 7,467,749 | B2 | 12/2008 | Tarabulski et al. | |
| 7,588,440 | B2 | 9/2009 | Smith | |
| 7,615,200 | B2 | 11/2009 | Lin et al. | |
| 7,815,881 | B2 | 10/2010 | Lin et al. | |
| 7,829,033 | B2 | 11/2010 | Sun et al. | |
| 8,220,274 | B2 | 7/2012 | Bono et al. | |
| 8,815,197 | B2 * | 8/2014 | Broderick ..... | B01D 53/8631 423/239.1 |
| 2004/0057888 | A1 | 3/2004 | Buzanowski | |
| 2004/0120872 | A1 | 6/2004 | Fan et al. | |
| 2012/0177553 | A1 | 7/2012 | Lindemann et al. | |

* cited by examiner

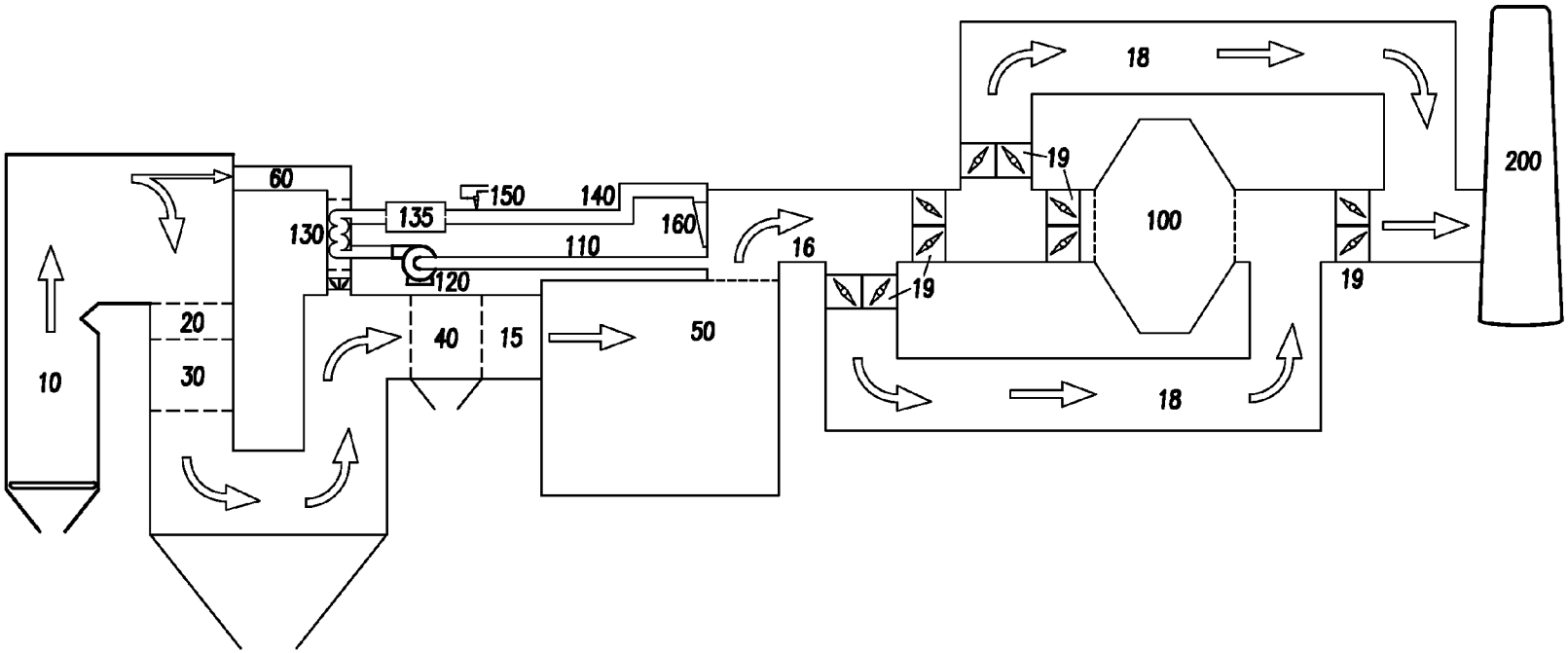
200
19
18
100
18
19
19
16
50
160
140
110
150
15
40
120
135
130
60
20
30
10

UREA DECOMPOSITION AND IMPROVED SCR NOX REDUCTION ON INDUSTRIAL AND SMALL UTILITY BOILERS

FIELD OF THE INVENTION

The present invention relates generally to the reduction of nitrogen oxide (NOx) emissions from industrial, commercial and small electric utility boilers and other lean burn stationary combustion sources. More particularly, the present invention relates to a system and method in which urea is converted to ammonia for use in NOx reduction by selective catalytic reduction (SCR), and even more particularly to such systems and methods that employ a side stream of exhaust gas to aid in urea to ammonia conversion.

BACKGROUND OF THE INVENTION

The reduction of nitrogen oxide ("NOx") emissions from industrial, commercial and small electric utility boilers, gas turbines, and other lean burn stationary combustion sources continues to be a challenge. Primary measures, such as low NOx burners, flue gas recirculation, water injection, fuel staging or air staging, need to balance the impact on the efficiency and stability of combustion with the level of NOx reduction obtained and the risk of increases in other regulated pollutants, such as carbon monoxide or unburned hydrocarbons. Secondary measures, including selective non catalytic reduction (SNCR) and selective catalytic reduction (SCR), involve the injection of reagents, such as ammonia or urea, into the upper furnace or the flue gases to chemically convert NOx to elemental nitrogen.

Ammonia reagent is regulated as a hazardous substance, which has driven many end users to consider aqueous urea reagent as an alternative. While aqueous urea is not a hazardous substance, its application for NOx reduction requires additional design effort to make certain that the urea is fully gasified and does not leave intermediate solid by products that can foul surfaces and reduce chemical utilization.

While injection of urea into the cavity formed between the second and third pass of a fire tube boiler has been demonstrated to provide conversion of urea to ammonia for SCR, as described in U.S. Patent Application Publication Nos. US 2012/0177553 A1 and US 2013/0152470 A1 (both titled "Injector and Method for Reducing NOx Emissions from Boilers, IC Engines and Combustion Processes"), the injection of urea directly into the furnace of some larger industrial and small utility boilers for SCR applications is not practical due to the tight tube spacing in the furnace convective zone which prevents adequate distribution of the reagent into the furnace gases. Urea deposition on boiler tube surfaces and corrosion of water wall surfaces in the boiler is also a concern with direct injection into the furnace convective zone. SNCR technology, while allowing for injection into the high temperature combustion zone of a furnace at typical temperatures of 1700° F.-2100° F., suffers from poor reagent utilization and lower NOx reduction rates of only 20-45% versus 80-95% for well designed SCR systems.

There have been several attempts to overcome the disadvantages of known urea based NOx reduction systems. For example, U.S. Pat. No. 7,815,881 to Lin et al. describes the use of a flue gas bypass duct for injection of urea and for conversion to ammonia for SCR. U.S. Pat. No. 7,090,810 to Sun et al. describes the reduction of NOx from large-scale combustors by injecting urea into a side stream of gases with temperature sufficient for gasification and a residence time of 1-10 seconds.

However, the patents of Lin and Sun appear directed at large utility boilers. Utility boilers normally have sufficient heat input, flue gas temperatures and furnace residence times to generate 50 MW or more of electric power and are typically rated at 100 MW-800 MW or more. Whereas most industrial commercial boilers are rated below 300 million Btu/hour heat input, or roughly 30 MW equivalent.

Additionally, U.S. Pat. No. 5,296,206 to Cho et al. describes a process directed at large utility boilers, which achieves reagent flow rates up to 3,000 lbs/hr using a heat exchanger disposed in the flue gas pass such that a heated transfer medium is used to vaporize an aqueous reducing agent, which is preferably aqueous ammonia. However, Cho requires the use of a separate vaporizer vessel where the aqueous solution and heated air are mixed at the top of the vessel and the preferred outlet temperature is 250° F.-500° F. The vaporization vessel of Cho represents an additional expensive piece of equipment that can be prone to plugging from the incomplete decomposition of urea, especially at the described low exit temperatures of 250° F.-500° F. described by Cho.

Due to their smaller size and generally lower baseline NOx emissions, the cost per ton of pollutant removed from an industrial boiler or small utility boiler can be extremely high when the capital intensive control technologies such as those of Sun, Lin and Cho, which are designed for large utility boilers, are applied to small utility or industrial and commercial boilers.

Other commercial processes for the conversion of urea to ammonia involve the use of supplemental heaters, burners or high temperature steam to provide heat for conversion of urea to ammonia and they often involve a separate storage vessel to hold the ammonia gas. U.S. Pat. No. 6,436,359 to Spencer and U.S. Pat. No. 6,322,762 to Cooper generally describe generating ammonia by heating urea under pressure. These systems can be complicated to control, require additional power to operate the heaters and are expensive relative to the cost of a small industrial or commercial boiler.

U.S. Pat. Nos. 5,968,464 and 6,203,770 to Peter-Hoblyn et al. describe the proposed conversion of urea to ammonia in the exhaust of a diesel engine by injecting urea onto the heated surfaces of a pyrolysis chamber mounted in the exhaust. The pyrolysis chamber is presented in the figures and described as a foraminous structure of sintered metal, glass or ceramic material inserted in the flue gas such that when urea is injected into the structure it is converted to ammonia which then exits the foraminous structure and mixes in the flue gas. However, this structure will quickly plug with unconverted urea byproducts. In U.S. Pat. No. 6,361,754 to Peter-Hoblyn et al. it is described to convert the urea solution to ammonia by injecting the urea into a heated line disposed within an exhaust pipe, with an optional heated vessel, and then releasing ammonia through a valve mechanism into the exhaust gases upstream of an SCR reactor. However, urea solution pumped into a small heated line would be prone to plugging of the line from urea decomposition products, which would present significant resistance to the continuing flow of urea solution through the line.

A further problem with all of the prior art systems and methods described above that employ bypass or slipstream ducts for ammonia to urea conversion relates to the standard use of particulate control devices (such as mechanical separators, bag houses, etc.) in connection with modern boilers firing coal, oil and bio mass fuels. The exhaust gases are hottest immediately downstream of the combustion chamber of the boiler, and it is desirable to employ this heat as part of the ammonia to urea conversion, so that any supplemental heating required can be kept low. Thus, it is desirable to position the inlet to the bypass or slipstream duct close to the combustion chamber of the furnace (and prior to downstream components such as economizers and air heaters that cool the exhaust gas).

However, when this is done, a question arises as to where to position the outlet of the slipstream, after the urea has been injected therein. If the outlet for the slipstream is positioned in the vicinity of the inlet (i.e., close to the combustion chamber of the boiler), the gasified ammonia will pass through the downstream components, including downstream particulate control devices (such as mechanical separators, bag houses, etc.). This may be problematic, since the gasified ammonia passing through the particulate control devices may react with solids and gaseous species in the particulate control devices to form byproducts that can foul the particulate control devices or which can act to remove the ammonia from the gas stream prior to reaction across an even further downstream SCR catalyst, thereby reducing the efficiency of the process.

On the other hand, if the outlet for the slipstream is positioned downstream of the particulate control devices (such as mechanical separators, bag houses, etc.), the problem arises that the exhaust gas passing through the slip stream has never flowed through the particulate control devices, such that the particulates bypassing the particulate control devices may foul the ammonia injection grid (AIG), SCR catalyst and/or be released into the atmosphere, thereby reducing the efficiency of the process.

Thus, according to known designs, one of the following is generally true: (1) the inlet of the slipstream or bypass duct in which urea is converted to ammonia is positioned downstream of the particulate control devices, meaning that a significant portion of the heat of the exhaust gas leaving the combustion zone of the boiler is not used in the urea to ammonia conversion; (2) the inlet of the slipstream or bypass duct in which urea is converted to ammonia is positioned in close proximity to the combustion zone of the boiler and the outlet of the slipstream is positioned upstream of the particulate control devices, meaning that undesirable reactions of the ammonia within the particulate control devices may take place; or (3) the inlet of the slipstream or bypass duct in which urea is converted to ammonia is positioned in close proximity to the combustion zone of the boiler and the outlet of the slipstream is positioned downstream of the particulate control devices, meaning that some of the exhaust gases bypass the particulate control devices such that particulates may reach the AIG, SCR catalyst and or the stack.

Therefore, what is desired is a boiler employing a slipstream or bypass duct of exhaust gas in which urea is converted to ammonia, which takes advantage of the heat present in the primary exhaust stream exiting the combustion zone of the boiler in converting the urea to ammonia, and also which ensures that all of the exhaust gas is passed through the particulate control devices positioned in the primary exhaust stream.

SUMMARY OF THE INVENTION

In accordance with one aspect of the present invention, a lean burn combustion source having reduced NOx emissions comprises a furnace in which combustion takes place with a primary exhaust gas stream exiting the furnace, at least one particulate control device through which the primary exhaust gas stream flows positioned downstream of the furnace and a catalyst effective for NOx reduction through which the primary exhaust gas stream flows positioned downstream of the at least one particulate control device. A first side stream of hot exhaust gas is provided through which a portion of the primary exhaust gas stream flows, the first side stream comprising an inlet positioned downstream of the furnace and upstream of the at least one particulate control device and an outlet positioned downstream of the furnace and upstream of the at least one particulate control device. A second side stream of hot exhaust gas is also provided through which a portion of the primary exhaust gas stream flows, the second side stream comprising: an inlet positioned downstream of the at least one particulate control device and upstream of the catalyst, a heat exchanger section passing through the first side stream, whereby heat from the hot exhaust gas flowing through the first side stream is transferred to the hot exhaust gas flowing through the second side stream, at least one injector positioned in the second side stream downstream of the heat exchanger section with respect to flow of hot exhaust gas through the second side stream, the at least one injector injecting aqueous based reagent into the hot exhaust gas flowing through the second side stream such that the aqueous based reagent decomposes to ammonia gas, and an outlet in fluid communication with a reagent distribution device positioned in the primary exhaust gas stream downstream of the at least one particulate control device and upstream of the catalyst. The hot exhaust gas flowing through the second side stream, carrying the ammonia gas, is injected into the primary exhaust gas stream through the reagent distribution device, whereby a mixture of the hot exhaust gas flowing through the second side stream, carrying the ammonia gas, and the primary exhaust gas stream are caused to flow over the catalyst.

In some embodiments, the at least one particulate control device comprises at least one of a mechanical separator and a bag house.

In some embodiments, the lean burn combustion source further comprises an economizer through which the primary exhaust gas stream flows, the economizer positioned downstream of the furnace and upstream of the at least one particulate control device. In certain of these embodiments, the inlet of the first side stream is positioned downstream of the furnace and upstream of the economizer and the outlet of the first side stream is positioned downstream of the economizer and upstream of at least one particulate control device, such that the first side stream bypasses the economizer.

In some embodiments, the lean burn combustion source further comprises an air heater through which the primary exhaust gas stream flows, the air heater positioned downstream of the furnace and upstream of the at least one particulate control device. In certain of these embodiments, the inlet of the first side stream is positioned downstream of the furnace and upstream of the air heater and the outlet of the first side stream is positioned downstream of the air heater and upstream of at least one particulate control device, such that the first side stream bypasses the air heater.

In some embodiments, the second side stream comprises a continuous duct passing between the inlet of the second side stream and the outlet of the second side stream. In certain of these embodiments, a portion of the continuous duct between the inlet of the second side stream and the heat exchanger portion is 10-14 inches in diameter, the heat exchanger portion of the continuous duct is 2-4 inches in diameter and a portion of the continuous duct between the at least one injector and the outlet of the second side stream is 12-16 inches in diameter.

In some embodiments, a residence time from the point of aqueous reagent injection into the second side stream until the introduction of the gasified reagent into the primary exhaust gas stream is less than 1 second.

In some embodiments, the lean burn combustion source further comprises a supplemental heater positioned in the second side stream downstream of the heat exchanger section with respect to the flow of hot exhaust gas through the second side stream and upstream of the at least one injector with respect to the flow of hot exhaust gas through the second side stream.

In some embodiments, the lean burn combustion source further comprises a fan positioned in the second side stream upstream of the heat exchanger section with respect to the flow of hot exhaust gas through the second side stream.

In some embodiments, the reagent distribution device comprises an ammonia injection grid (AIG).

In some embodiments, the reagent distribution device comprises a reagent distribution funnel. In certain of these embodiments, the reagent distribution funnel comprises a tapered length from a larger area inlet end in communication with the outlet of the second side stream to a narrower closed outlet end and has multiple outlets of 1-4 inches diameter running along the tapered length, the funnel outlets being mated to ports on a duct wall of the primary exhaust gas stream such that the gasified reagent is introduced under pressure into the primary exhaust gas flow upstream of the catalyst.

In some embodiments, the lean burn combustion further comprises a series of dampers and ducts positioned in the vicinity of the catalyst and arranged such that flow of the mixture of the hot exhaust gas flowing through the second side stream, carrying the ammonia gas, and the primary exhaust gas stream is reversible, and can flow through the catalyst in a forward direction and can be reversed to flow in the opposite direction through the catalyst to remove ash deposits that have accumulated on surfaces of the catalyst. In certain of these embodiments, the series of dampers and ducts are also configured to selectively direct the mixture of the hot exhaust gas flowing through the second side stream, carrying the ammonia gas, and the primary exhaust gas stream around the catalyst during upsets, catalyst maintenance or low exhaust gas temperatures.

In some embodiments, an amount of hot exhaust gas flowing through the first side stream of hot exhaust gas represents 10%-25% of the flow of the primary exhaust gas stream.

In some embodiments, an amount of hot exhaust gas flowing through the second side stream of hot exhaust gas represents 1%-3% of the flow of the primary exhaust gas stream.

In some embodiments, the aqueous based reagent comprises at least one of aqueous urea and aqueous ammonia.

BRIEF DESCRIPTION OF THE DRAWINGS

FIG. 1 is a schematic view of an exemplary embodiment of a system configured in accordance with the present invention.

DETAILED DESCRIPTION OF THE INVENTION

On an industrial boiler firing coal, oil, natural gas, biomass, waste fuels or combinations of fuels, a bypass duct is used to extract hot flue gas from the convective zone before the economizer and air heater. Approximately 10-25% and preferably 15% of the flue gas may be directed through the bypass duct by a damper and extracted at a preferred temperature of 750° F. Supplemental duct firing or tempering by water or air injection may be used to maintain the temperature in the bypass duct at 750° F. as boiler load changes.

The hot gas flow in the bypass duct is returned to the main exhaust gas stream downstream of the economizer and air heater but upstream of particulate control devices, such as a mechanical separator and a bag house. This arrangement is used to raise the inlet gas temperature to the bag house such that the temperature exiting the bag house is increased from as low as 325° F., but more typically 375° F.-390° F. without use of the bypass, to 400° F.-430° F. with the bypass damper open. The increase in the gas temperature from the bag house has a beneficial impact on the performance of a downstream SCR catalyst used for NOx reduction.

The volume and cost of the SCR catalyst can be reduced and/or the performance improved due to the higher exhaust gas temperatures through the SCR, which improves SCR catalyst efficiency. An induced draft fan is used to assist flow through the exhaust and can be located after the mechanical separator and before the bag house as one example. A damper in the bypass duct is used to regulate the amount of gas that bypasses the economizer and air heater.

Installed in the bypass duct at a location where the temperature is 650° F.-850° F., and preferably 750° F., is a gas-to-gas heat exchanger representing a portion of a continuous urea decomposition duct. This heat exchanger draws a slipstream of hot exhaust gas from the outlet of the bag house at 400° F.-430° F. and uses a fan to circulate this hot gas through the heat exchanger portion of the decomposition duct where the gas temperature in the heat exchanger is raised to 750° F. The gas flow in the heat exchanger represents 1%-3% of the total gas volume.

Urea is injected into the slipstream downstream of the heat exchanger outlet using one or multiple injectors. The 750° F. gas temperature at the point of urea injection causes the injected urea solution to be gasified. Injectors such as a return flow injector described in U.S. Pat. No. 7,467,749 provide good atomization and are self cooling without the need for atomizing, transport or cooling air; however, other injectors known in the art, including those using air assistance, can also be used.

The portion of the continuous duct leading to the inlet of the heat exchanger is typically 10-14 inches diameter, and the heat exchanger portion is typically 2-4 inches diameter and may include multiple small ducts and an inlet and outlet manifold as is standard practice for heat exchanger design. The heat exchanger outlet duct can be expanded from the 2-4 inches diameter smaller ducts into a common duct of a nominal 12-16 inches diameter at the point of urea injection such that the aqueous urea is fully decomposed and gasified in the decomposition portion of the duct. The resulting gasified reagent, including ammonia gas, is transported by the hot gas flow from the heat exchanger and decomposition portion of the duct to an ammonia injection grid or an ammonia distribution funnel that is disposed in the outlet duct of the bag house at a point in the primary exhaust stream that is downstream from the point where the hot gas slipstream is extracted for flow through the heat exchanger. The injected ammonia reacts in the bulk exhaust gas across a downstream SCR catalyst for the reduction of NOx.

In this novel arrangement, the bypass of gas around the boiler economizer and air heater and reintroduction to the primary gas stream at a point upstream of the mechanical separator serves both to raise the temperature through the downstream bag house and SCR and provides the heat transfer to the gas flowing through the heat exchanger module that is used for the urea decomposition and gasification.

It has been found that small quantities of aqueous urea solution, from 1-10 gallons/per hour, can be gasified in under one second residence time if the gas temperature at the inlet to the urea decomposition portion of the continuous duct is at least 650° F., and preferably 700° F.-750° F. In cases where the temperature to the decomposition duct cannot be maintained at 650° F.-750° F. solely by the heat exchanger, supplemental electric heaters or burners may be employed to raise the slipstream gas temperature to 650° F.; or, higher gas flow rates through the heat exchanger can be used to assist with urea gasification at temperatures below 650° F.

In contrast to known systems where urea is injected directly into the bypass gas stream, the present invention injects urea into a side stream formed from gases extracted after the bag house, which side stream is heated to at least 650° F. by flowing through the gas-to-gas heat exchanger arrangement prior to the point of urea injection. This avoids the potential issues from having ammonia gas pass through the bag house where it can react with solids and gaseous species in the bag house to form byproducts that can foul the bag house or which can act to remove ammonia from the gas stream prior to reaction across the downstream SCR catalyst thereby reducing the efficiency of the process. This also ensures that all of the exhaust gas is passed through the mechanical separator and the bag house positioned in the primary exhaust stream, such that the amount of particulates reaching the AIG, SCR catalyst and the stack is greatly reduced.

In one preferred embodiment, a reverse flow of exhaust gases through the SCR catalyst can be used to clear ash and/or soot deposits from the catalyst surfaces. These deposits can mask the active catalytic sites in the catalyst thereby reducing performance. Dampers and duct work are used to direct the exhaust gases after the AIG in a reverse direction through the catalyst and then through a bypass duct connected to the stack. In this way ash deposits can be cleared from the catalyst surfaces. Reagent injection can be continued during the reverse flow operation such that NOx reduction is obtained through the catalyst even during reverse flow operation; however, it may be desirable to pause injection for several minutes as reverse flow is initiated.

Referring now specifically, to FIG. 1, provided is a general arrangement of an exemplary embodiment of a system configured in accordance with the current invention, which system is used to reduce emissions of nitrogen oxides (NOx) from a small utility boiler rated at 170,000 lbs/hr of steam and designed to combust bio mass fuel.

In FIG. 1, the combustion of biomass fuel and air in the furnace (10) generates hot flue gases containing oxides of nitrogen emitted out exhaust stack (200). Uncontrolled emissions of NOx are 0.18 lbs/mmBtu at full load.

Combustion gases flow through the furnace (10) where heat is extracted by the water-cooled walls of the furnace to generate steam. The combustion gases flow through an economizer section (20) which extracts additional heat from the hot exhaust gases and then through an air heater (30) which is used to heat incoming combustion air and results in a reduced temperature of the combustion gases at a location in the furnace exit after the air heater (30). Flue gas continues on a route through a mechanical separator (40) used to take out particulate matter and then the gas enters the bag house (50) which separates fine particulate matter from the flue gas. Exhaust gas from the bag house at (16) exits at a normal temperature of 370° F.-390° F., which is generally below the optimum temperature for good performance of the downstream SCR equipment (100).

A slip stream (110) of the bag house outlet gases (representing 6700 lbs/hr or 2 percent of total flue gas flow) (16) is routed through a continuous urea decomposition duct and directed firstly through a fan (120) and then through a heat exchanger section (130) of the continuous decomposition duct which is disposed in an exhaust slip stream (60) of the primary exhaust that is bypassed around the economizer (20) section and air heater (30) through economizer by pass duct (60). The exhaust slipstream is typically at a temperature of 700° F.-750° F. at full load. The exhaust slipstream is directed through the economizer bypass duct (60) and is then reintroduced into the primary exhaust stream upstream of mechanical separator (40). This helps raise the gas temperature of the primary exhaust at the point (15) entering the bag house and subsequently the temperature of the gases exhausted from the bag house at point (16). Higher temperature flue gas out of the bag house, in a range of 400° F.-430° F. at full load, at point (16) enter the SCR catalyst (100) and lead to improved SCR catalyst performance and also potentially to reduced catalyst volumes as the catalytic activity is better at temperatures above 400° F.

In the economizer bypass duct (60) there is disposed a gas-to-gas heat exchanger coil portion of a continuous decomposition duct. An exhaust side stream representing 1%-3% of the total exhaust from the bag house (16) is pulled by a fan (120) through the decomposition duct and forced through the heat exchanger portion (130) of the continuous duct to raise the temperature of the side stream to 600° F.-750° F. at the outlet of the heat exchanger portion of the duct. The outlet of the heat exchanger duct (130) is connected to the inlet of a urea decomposition duct (140) upon which is fixed a urea reagent injector (150) that is designed to inject a controlled quantity of reagent into the decomposition portion of the continuous duct.

A supplemental heater (135) can be placed downstream of the heat exchanger outlet and upstream of the injector (150) to maintain the gas temperature into the decomposition portion of the duct (140) to at least 650° F.-750° F. and preferably above 700° F. The decomposition duct (140) is an expanded section of the continuous duct and is typically 12-18 inches diameter and preferably in the current example is 14 inches diameter.

The aqueous based reagent is injected into the decomposition duct (140) at a rate between 0.5-10 gallons per hour depending on boiler load and NOx. The reagent can be an aqueous solution of urea or ammonia and is injected through injector (150) into the decomposition duct (140) at a rate of 0.5-10 gallons per hour. A pump and controller (not shown), for example the system marketed as the TRIM-NOX® injection system by Combustion Components Associates Inc of Monroe, Conn., can be used to regulate the rate of urea injection as a function of boiler load or outlet NOx. In the current example, a 50% solution of urea is injected at a rate of 6.0-7.0 gph when the boiler is at full load to supply adequate reagent to reduce the uncontrolled NOx from the boiler of 0.18 lbs/mmBtu down to 0.065 lbs/mmBtu following the SCR catalyst. Other applications may find the use of a 32% or 40% solution of aqueous urea convenient or even a 19% or 25% solution of aqueous ammonia reagent.

Injectors (150) can be of the single fluid return flow type injector as described in U.S. Pat. No. 7,467,749 or can use air assistance for atomization and distribution as further described in U.S. Patent Application Publication No. US 2012/0177553 A1. Atomizing air at a rate of 15 acfm at 40 psi is used to assist the injection of up to 7 gph of a 50% urea solution under full load conditions. The injection rate is automatically adjusted by a programmable logic controller (PLC) to match the boiler load and corresponding NOx emission rate. Multiple injectors can be affixed to the duct and operated individually, sequentially or concurrently.

The urea reagent is injected and decomposed in the duct and is transported by the hot gas to a novel ammonia distribution funnel (160) or alternatively to a traditional ammonia injection grid (AIG). AIG designs are well known to those skilled in the art.

The distribution funnel in the present example is a novel design that is mounted external to the duct on the sidewall or on top of the primary exhaust duct after the bag house and slip stream take off point but upstream of the SCR catalyst. It is 12 feet tall in the current example and mounted on a primary exhaust duct that is 4 feet wide and also 12 feet tall. The distribution funnel is tapered from the inlet end that receives the gas from the decomposition duct to the bottom end. The funnel has multiple 3 inch outlet ports along its length that are mated to similar ports in the exhaust duct. The funnel and ports are under pressure from the hot carrier gas in the decomposition duct and decomposed urea reagent, now as a gas, is introduced into the primary exhaust that feeds the SCR.

The ammonia injection funnel of the current invention has the advantage of mating to the outside of the exhaust duct, thus eliminating the need to mount multiple spargers and lances across the interior of the primary exhaust duct. The funnel also has the advantage of using large outlet holes which reduces the potential for plugging of the small holes on a traditional AIG and is particularly advantageous in eliminating plugging from unconverted urea decomposition by products. Flow conditioning devices can be installed in the primary exhaust upstream or downstream of the injection funnel to assist with mixing and distribution of reagent before the catalyst face.

Additional bypass ductwork (18) along with dampers (19) are used to alternately reverse the flow of exhaust gases through the SCR catalyst and represent a simple way of clearing the catalyst of ash deposits. Bypass ductwork (18) and dampers (19) can be used to bypass the SCR during low temperature start-up or shut down conditions and to direct exhaust from the bag house (50) outlet directly to the stack (200). Urea injection can be automatically stopped by the injection system controller if the SCR catalyst is bypassed due to low exhaust temperatures. The ammonia injection funnel is located upstream of the bypass ductwork (18) and dampers (19) so the gasified ammonia is introduced to the primary exhaust stream before the primary exhaust stream is directed to either forward or reverse flow across the SCR catalyst (100) by the bypass ductwork (18) and dampers (19).

Although the invention has been described with reference to a particular arrangement of parts, features and the like, these are not intended to exhaust all possible arrangements or features, and indeed many modifications and variations will be ascertainable to those of skill in the art.

What is claimed is:

1. An apparatus providing a lean burn combustion source having reduced NOx emissions, said apparatus comprising:

a furnace in which combustion takes place with a primary exhaust gas stream exiting said furnace;

at least one particulate control device through which the primary exhaust gas stream flows positioned downstream of said furnace;

a catalyst effective for NOx reduction through which the primary exhaust gas stream flows positioned downstream of said at least one particulate control device;

a bypass duct providing a first side stream of hot exhaust gas through which a portion of the primary exhaust gas stream flows, said bypass duct comprising an inlet positioned downstream of said furnace and upstream of said at least one particulate control device and an outlet positioned downstream of said furnace and upstream of said at least one particulate control device;

a decomposition duct providing a second side stream of hot exhaust gas through which a portion of the primary exhaust gas stream flows, said decomposition duct comprising:

an inlet positioned downstream of said at least one particulate control device and upstream of said catalyst;

a heat exchanger section passing through said first side stream, whereby heat from the hot exhaust gas flowing through said bypass duct is transferred to the hot exhaust gas flowing through said decomposition duct;

at least one injector positioned in said decomposition duct downstream of said heat exchanger section with respect to flow of hot exhaust gas through said decomposition duct , said at least one injector injecting aqueous based reagent into the hot exhaust gas flowing through said decomposition duct such that the aqueous based reagent decomposes to ammonia gas; and an outlet in fluid communication with a reagent distribution device positioned in the primary exhaust gas stream downstream of said at least one particulate control device and upstream of said catalyst; and wherein the hot exhaust gas flowing through said decomposition duct, carrying the ammonia gas, is injected into the primary exhaust gas stream through the reagent distribution device, whereby a mixture of the hot exhaust gas flowing through said decomposition duct, carrying the ammonia gas, and the primary exhaust gas stream are caused to flow over said catalyst.

2. The apparatus of claim 1, wherein said at least one particulate control device comprises at least one of a mechanical separator and a bag house.

3. The apparatus of claim 1, further comprising an economizer through which the primary exhaust gas stream flows, the economizer positioned downstream of said furnace and upstream of said at least one particulate control device.

4. The apparatus of claim 3, wherein the inlet of said bypass duct is positioned downstream of said furnace and upstream of said economizer and the outlet of said bypass duct is positioned downstream of said economizer and upstream of at least one particulate control device, such that said bypass duct bypasses said economizer.

5. The apparatus of claim 1, further comprising an air heater through which the primary exhaust gas stream flows, the air heater positioned downstream of said furnace and upstream of said at least one particulate control device.

6. The apparatus of claim 5, wherein the inlet of said bypass duct is positioned downstream of said furnace and upstream of said air heater and the outlet of said bypass duct is positioned downstream of said air heater and upstream of at least one particulate control device, such that said bypass duct said air heater.

7. The apparatus of claim 1, wherein said decomposition duct comprises a continuous duct passing between the inlet of said decomposition duct and the outlet of said decomposition duct.

8. The apparatus of claim 7, wherein a portion of the continuous duct between the inlet of said decomposition duct and said heat exchanger portion is 10-14 inches in diameter, the heat exchanger portion of the continuous duct is 2-4 inches in diameter and a portion of the continuous duct between the at least one injector and the outlet of decomposition duct is 12-16 inches in diameter.

9. The apparatus of claim 1, wherein when the apparatus is operated a residence time from the point of aqueous reagent injection into said decomposition duct until the introduction of the gasified reagent into the primary exhaust gas stream is less than 1 second.

10. The apparatus of claim 1, further comprising a supplemental heater positioned in said decomposition duct downstream of said heat exchanger section with respect to the flow of hot exhaust gas through said decomposition duct and upstream of said at least one injector with respect to the flow of hot exhaust gas through said decomposition duct.

11. The apparatus of claim 1, further comprising a fan positioned in said decomposition duct upstream of said heat exchanger section with respect to the flow of hot exhaust gas through said decomposition duct.

12. The apparatus of claim 1, wherein the reagent distribution device comprises an ammonia injection grid (AIG).

13. The apparatus of claim 1, wherein the reagent distribution device comprises a reagent distribution funnel.

14. The apparatus of claim 13, wherein said reagent distribution funnel comprises a tapered length from a larger area inlet end in communication with the outlet of said decomposition duct to a narrower closed outlet end and has multiple outlets of 1-4 inches diameter running along the tapered length, the funnel outlets being mated to ports on a duct wall of the primary exhaust gas stream such that the gasified reagent is introduced under pressure into the primary exhaust gas flow upstream of said catalyst.

15. The apparatus of claim 1, further comprising a series of dampers and ducts positioned in the vicinity of said catalyst and arranged such that flow of the mixture of the hot exhaust gas flowing through said decomposition duct, carrying the ammonia gas, and the primary exhaust gas stream is reversible, and can flow through said catalyst in a forward direction and can be reversed to flow in the opposite direction through said catalyst to remove ash deposits that have accumulated on surfaces of said catalyst.

16. The apparatus of claim 15, wherein the series of dampers and ducts are also configured to selectively direct the mixture of the hot exhaust gas flowing through said decomposition duct , carrying the ammonia gas, and the primary exhaust gas stream around said catalyst during upsets, catalyst maintenance or low exhaust gas temperatures.

17. The apparatus of claim 1, wherein when the apparatus is operated an amount of hot exhaust gas flowing through said bypass duct of hot exhaust gas represents 10%-25% of the flow of the primary exhaust gas stream.

18. The apparatus of claim 1, wherein when the apparatus is operated an amount of hot exhaust gas flowing through said decomposition duct of hot exhaust gas represents 1%-3% of the flow of the primary exhaust gas stream.

19. The apparatus of claim 1, wherein when the apparatus is operated the aqueous based reagent comprises at least one of aqueous urea and aqueous ammonia.

20. An apparatus providing a lean burn combustion source having reduced NOx emissions, said apparatus comprising:

a furnace in which combustion takes place with a primary exhaust gas stream exiting said furnace;

an economizer through which the primary exhaust gas stream flows, the economizer positioned downstream of said furnace and upstream of said at least one particulate control device;

an air heater through which the primary exhaust gas stream flows, the air heater positioned downstream of said furnace and upstream of said at least one particulate control device;

at least one particulate control device through which the primary exhaust gas stream flows positioned downstream of said furnace;

a catalyst effective for NOx reduction through which the primary exhaust gas stream flows positioned downstream of said at least one particulate control device;

a bypass duct providing a first side stream of hot exhaust gas through which a portion of the primary exhaust gas stream flows, said bypass duct comprising an inlet positioned downstream of said furnace and upstream said economizer and said air heater and an outlet positioned downstream of said economizer and said air heater and upstream of said at least one particulate control device, such that said bypass duct bypasses said economizer and said air heater;

a decomposition duct providing a second side stream of hot exhaust gas through which a portion of the primary exhaust gas stream flows, said decomposition duct comprising:

an inlet positioned downstream of said at least one particulate control device and upstream of said catalyst;

a heat exchanger section passing through said bypass duct, whereby heat from the hot exhaust gas flowing through said bypass duct is transferred to the hot exhaust gas flowing through said decomposition duct;

at least one injector positioned in said decomposition duct downstream of said heat exchanger section with respect to flow of hot exhaust gas through said decomposition duct, said at least one injector injecting aqueous based reagent into the hot exhaust gas flowing through said decomposition duct such that the aqueous based reagent decomposes to ammonia gas;

a fan positioned in said decomposition duct upstream of said heat exchanger section with respect to the flow of hot exhaust gas through said decomposition duct;

a supplemental heater positioned in said decomposition duct downstream of said heat exchanger section with respect to the flow of hot exhaust gas through said decomposition duct and upstream of said at least one injector with respect to the flow of hot exhaust gas through said decomposition duct;

an outlet in fluid communication with a reagent distribution device positioned in the primary exhaust gas stream downstream of said at least one particulate control device and upstream of said catalyst; and wherein said decomposition duct comprises a continuous duct passing between the inlet of said decomposition duct and the outlet of said decomposition duct; and wherein the hot exhaust gas flowing through said decomposition duct, carrying the ammonia gas, is injected into the primary exhaust gas stream through the reagent distribution device, whereby a mixture of the hot exhaust gas flowing through said decomposition duct, carrying the ammonia gas, and the primary exhaust gas stream are caused to flow over said catalyst.

21. The apparatus of claim 20, wherein said at least one particulate control device comprises at least one of a mechanical separator and a bag house.

22. The apparatus of claim 20, wherein a portion of the continuous duct between the inlet of said decomposition duct and said heat exchanger portion is 10-14 inches in diameter, the heat exchanger portion of the continuous duct is 2-4 inches in diameter and a portion of the continuous duct between the at least one injector and the outlet of said decomposition duct is 12-16 inches in diameter.

23. The apparatus of claim 20, wherein when the apparatus is operated a residence time from the point of aqueous reagent injection into said decomposition duct until the introduction of the gasified reagent into the primary exhaust gas stream is less than 1 second.

24. The apparatus of claim 20, wherein the reagent distribution device comprises an ammonia injection grid (AIG).

25. The apparatus of claim 20, wherein the reagent distribution device comprises a reagent distribution funnel.

26. The apparatus of claim 25, wherein said reagent distribution funnel comprises a tapered length from a larger area inlet end in communication with the outlet of said decomposition duct to a narrower closed outlet end and has multiple outlets of 1-4 inches diameter running along the tapered length, the funnel outlets being mated to ports on a duct wall of the primary exhaust gas stream such that the gasified reagent is introduced under pressure into the primary exhaust gas flow upstream of said catalyst.

27. The apparatus of claim 20, further comprising a series of dampers and ducts positioned in the vicinity of said catalyst and arranged such that flow of the mixture of the hot exhaust gas flowing through said decomposition duct, carrying the ammonia gas, and the primary exhaust gas stream is reversible, and can flow through said catalyst in a forward direction and can be reversed to flow in the opposite direction through said catalyst to remove ash deposits that have accumulated on surfaces of said catalyst.

28. The apparatus of claim 27, wherein the series of dampers and ducts are also configured to selectively direct the mixture of the hot exhaust gas flowing through said decomposition duct, carrying the ammonia gas, and the primary exhaust gas stream around said catalyst during upsets, catalyst maintenance or low exhaust gas temperatures.

29. The apparatus of claim 20, wherein when the apparatus is operated an amount of hot exhaust gas flowing through said bypass duct of hot exhaust gas represents 10%-25% of the flow of the primary exhaust gas stream.

30. The apparatus of claim 20, wherein when the apparatus is operated an amount of hot exhaust gas flowing through said decomposition duct of hot exhaust gas represents 1%-3% of the flow of the primary exhaust gas stream.

31. The apparatus of claim 20, wherein when the apparatus is operated the aqueous based reagent comprises at least one of aqueous urea and aqueous ammonia.

* * * * *